US006915775B2

(12) United States Patent
Patterson et al.

(10) Patent No.: US 6,915,775 B2
(45) Date of Patent: Jul. 12, 2005

(54) ENGINE OPERATING METHOD AND APPARATUS

(75) Inventors: Gary J. Patterson, Utica, MI (US); Alan W. Hayman, Romeo, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/672,952

(22) Filed: Sep. 26, 2003

(65) Prior Publication Data

US 2005/0066932 A1 Mar. 31, 2005

(51) Int. Cl.[7] ..... F01L 1/34
(52) U.S. Cl. ..... 123/198 F; 123/198 DB; 123/90.16
(58) Field of Search ..... 123/198 F, 198 DB, 123/90.16

(56) References Cited

U.S. PATENT DOCUMENTS 4,516,542 A * 5/1985 Aoyoma et al. ..... 123/90.16
4,584,974 A * 4/1986 Aoyama et al. ..... 123/90.16
5,544,628 A * 8/1996 Voigt ..... 123/90.16
5,758,616 A * 6/1998 Motose ..... 123/198 F
5,778,839 A * 7/1998 Speil ..... 123/90.16
5,992,390 A * 11/1999 Moyer ..... 123/481
6,237,559 B1 * 5/2001 Russ et al. ..... 123/198 F
6,332,445 B1 * 12/2001 Voss et al. ..... 123/198 F
6,647,935 B2 * 11/2003 Aoyama et al. ..... 123/90.16
6,694,948 B2 * 2/2004 Glugla et al. ..... 123/404
6,752,121 B2 * 6/2004 Rayl et al. ..... 123/198 F

* cited by examiner

*Primary Examiner*—Henry C. Yuen
*Assistant Examiner*—Jason Benton
(74) *Attorney, Agent, or Firm*—Leslie C. Hodges

(57) ABSTRACT

An internal combustion engine includes a plurality of cylinders each having intake and exhaust valves and at least one camshaft timed to operate the valves with a high performance fixed overlap. Each camshaft has a cam phaser controlled to equally vary the intake and exhaust valve timing for superior full throttle performance over the engine speed range; Valve deactivation mechanisms operate to deactivate up to half the cylinders during idle and light load operation for increasing fuel efficiency and emission control and maintaining stable operation of the operating cylinders. The engine may also be started with half the cylinders cut out and then run with stable operation in this mode during idle and light load because the increased load on the operating cylinders gives stable operation with an increased valve overlap permitting increased performance and emission control at higher load operation on all the cylinders.

6 Claims, 1 Drawing Sheet

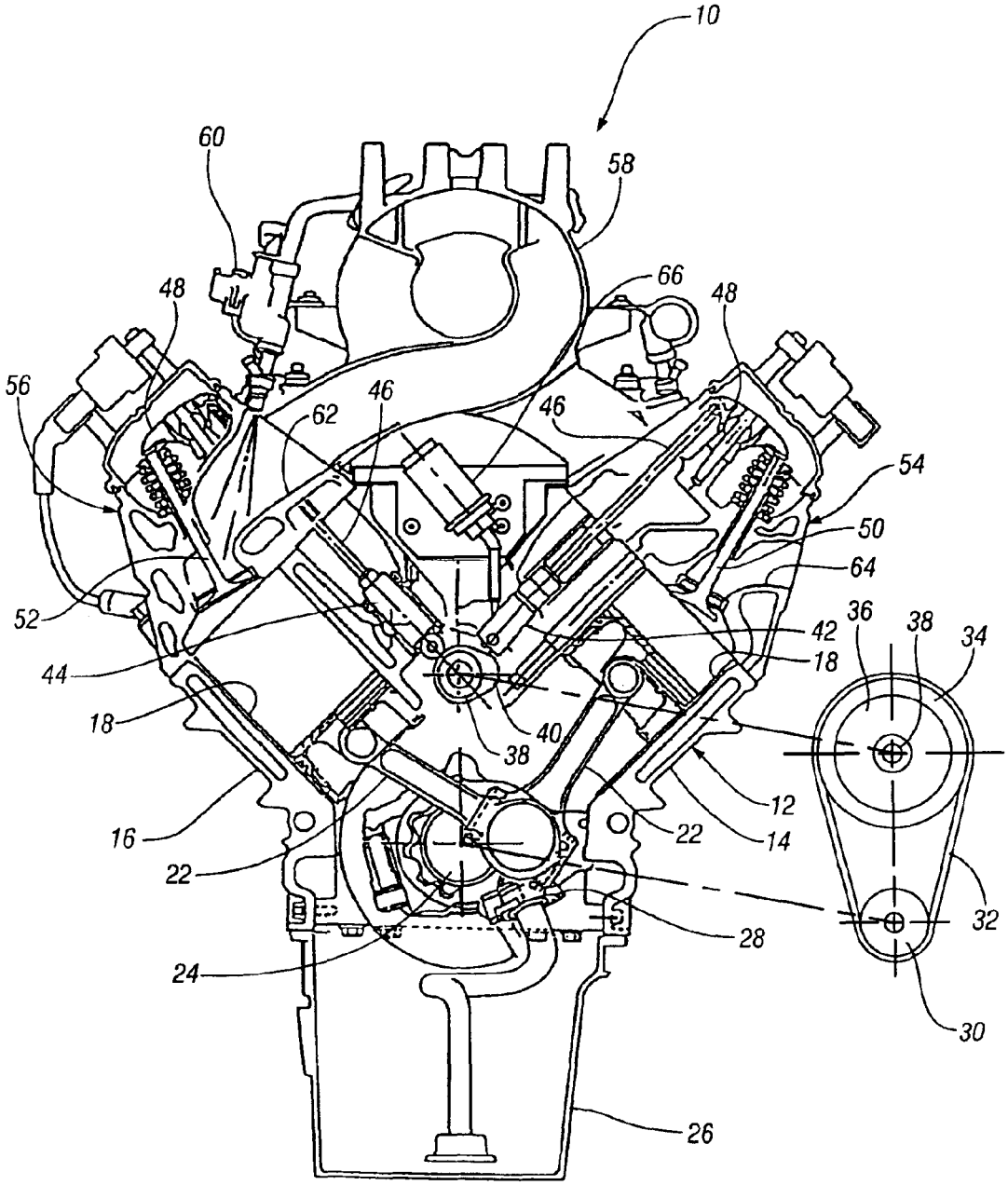
10
60
58
66
48
48
56
62
46
46
54
50
64
52
42
36
38
34
44
18
18
40
38
12
16
22
14
22
32
28
24
30
26

ENGINE OPERATING METHOD AND APPARATUS

TECHNICAL FIELD

This invention relates to engines and, more particularly, to a method of operation and apparatus for increasing emission control and performance of single camshaft and comparable engines.

BACKGROUND OF THE INVENTION

It is known in the art relating to engine emission control that valve event induced combustion residuals in the cylinders are a fundamental limitation on permissible intake/exhaust valve overlap for providing acceptable engine idle smoothness and stability. Many sophisticated methods have been employed by various manufacturers to overcome this limitation. These include intake valve event phasing, exhaust valve event phasing, and dual independent camshaft phasing.

Unfortunately these solutions are not readily applicable to single overhead camshaft (SOHC) or cam-in-block engines because the exhaust and intake cam lobes are on the same physical camshaft. A camshaft phaser, or cam phaser, controlling such a cam/valve train has only a very minor impact on trapped idle residuals, and generally increases residuals as the timing is advanced or retarded significantly from an optimum timing without variable timing capability, which worsens the idle quality situation.

SUMMARY OF THE INVENTION

The present invention provides a solution that employs cylinder deactivation (cutout) in operation of the engine at idle and at low loads. By cutting out cylinders, the load on the operating cylinders is increased. For example, cutting out one bank of cylinders of a V-6 engine doubles the load on the remaining three cylinders, increasing manifold pressure and reducing the trapped residuals.

With the idle cylinder load increased, the valve overlap may be significantly increased. This provides gains in wide open throttle (WOT) bmep (torque) and road load emissions and fuel efficiency with all cylinders operating. The addition of dual equal camshaft phasing, wherein the intake and exhaust valve events are retarded and/or advanced simultaneously and equally, significantly enhances the benefits to road load and WOT bmep.

With cylinder deactivation employed at idle and the resulting improvement in combustion stability, the engine camshaft designer is free to increase the valve overlap area to more fully optimize WOT torque and power, and road load fuel economy and emissions. With the idle constraint reduced significantly, the optimum overlap area/lobe center spacing can be accurately determined with extensive engine testing and analysis to provide an increased torque curve and reduced road load fuel consumption and emissions simultaneously. As used in the claims, the phrase "high fixed intake and exhaust valve overlap" is intended to encompass a range of intake/exhaust valve opening overlap areas greater than that which would provide acceptable engine idle quality in a particular vehicle engine with all cylinders firing.

These and other features and advantages of the invention will be more fully understood from the following description of certain specific embodiments of the invention taken together with the accompanying drawings.

BRIEF DESCRIPTION OF THE DRAWING

The single FIGURE of the drawing is a cross-sectional view of a cam-in-block engine having the front end cam timing elements offset to illustrate all features of the invention.

DESCRIPTION OF THE PREFERRED EMBODIMENT

Referring now to the drawing in detail, numeral 10 generally indicates an automotive V8 engine shown in cross-section and having a cam-in-block overhead valve train. Engine 10 includes a cylinder block 12 having left and right cylinder banks 14, 16 each including four cylinders. The banks are arranged at a ninety degree angle. The cylinders 18 carry pistons 20 which are reciprocated in the cylinders through connection by connecting rods 22 with a crankshaft 24. An oil pan 26 is mounted below the cylinder block 12 and is adapted to contain oil for delivery through an engine driven oil pump 28 to the various moving components of the engine.

As indicated in a displaced portion of the FIGURE, the crankshaft 24 is connected at a front end, not shown, of the engine with a drive sprocket 30. A chain 32 connects the drive sprocket with a driven sprocket 34 mounting a cam phaser 36. The cam phaser connects with a camshaft 38 mounted within the cylinder block 12. The camshaft 38 includes a plurality of cam lobes 40 that are operative to actuate valve lifters 42, 44 which connect through push rods 46 and rocker arms 48 to actuate the exhaust and intake valves 50, 52, respectively, of the engine cylinders.

The rocker arms and valves are mounted in cylinder heads 54, 56 carried on the cylinder banks 14, 16, respectively, and closing the upper ends of the cylinders 18 of the respective banks.

An intake manifold 58 supplies intake air and fuel injectors 60 supply fuel to cylinder intake ports 62 which are controlled by the intake valves 52 to allow timed admission of the air and fuel mixture into the cylinders. Exhaust valves 50 are operated in like manner to control the discharge of combustion products from the cylinders through cylinder exhaust ports 64.

In accordance with the invention, selected engine cylinders, including at least half the engine cylinders, are provided with so called switching lifters 42, 44 for actuating the intake and the exhaust valves. The lifters of the other engine cylinders may be conventional hydraulic lifters or, if desired, could also utilize switching lifters as do the selected cylinders. The switching lifters when actuated operate to deactivate the valves of selected cylinders so that operation of the cylinders is cut out completely and the engine operates on the remaining cylinders. Fuel injection into the cylinders is also discontinued when the cylinders are cut out by actuation of the switching lifters. A solenoid control valve 66 may be provided to control the oil pressure supplied to the deactivation portion of the switching lifters to change their mode of operation between normal powered operation and non-powered cylinder cut out.

The use of cam phasers on one or both camshafts of a double overhead cam engine has been proposed for varying the timing of at least one of the camshafts in order to increase or decrease the valve opening overlap of the end of closing of the exhaust valve and the beginning of opening of the intake valve of the same cylinder. Variation of valve overlap can be effective for controlling so called internal exhaust recirculation or, in other words, retention of exhaust gases in the cylinder, in order to obtain better control of emissions such as NOx, over a wide range of engine operation.

However, this use of a cam phaser is not possible on an engine where all of the cams are on the same camshaft as is the case in the cam-in-block engine 10 described above. The valve overlap in such an engine is necessarily fixed by the positioning of the cams on the camshaft and cannot be changed by varying the timing of the camshaft. Thus, the camshaft timing in such engines is generally limited by the requirements of maintaining smooth and stable idle operation of the engine at the expense of higher performance when the valve overlap is increased and of increased emission control by the same process of increasing the valve overlap.

Also, switching lifters have been utilized for cutting out certain engine cylinders during road load operation at less than full throttle in order to maintain the remaining operating cylinders at a higher load level for greater efficiency of the overall engine operation as well as improved emission control. However, this does not alone change the situation with respect to limitation of the amount of valve overlap allowed by the requirements of a smooth engine idle.

In the present invention, the characteristics of the switching lifters are combined with the application of a cam phaser to the camshaft of a cam-in-block or other comparable engine in order to provide a novel method of engine operation for improving both engine performance and emission control. In the operating method of the invention, idle and low load operation of the engine are conducted with up to one half of the cylinders of the engine cut out so that the engine is idled or operated at low loads on only one half of the cylinders operating at a substantially increased load level.

This allows the camshaft to be designed with increased valve overlap, which will still provide stable idle operation because the cylinders are operating at a higher load level where increased valve overlap does not cause instability. At the same time, idle efficiency is improved and emission control in the idle condition is also improved. The increase in the valve overlap also assists in controlling NOx emissions at intermediate loads and speeds and allows greatly improved engine performance under wide open throttle conditions. Further, the addition of the cam phaser 36 to control timing of the engine camshaft allows increased control of emissions at part load during cruising and other modes of vehicle operation at less than full throttle or near wide open throttle.

Accordingly, it has been shown that the operation of an engine having a camshaft with a fixed valve timing may be improved by the combination of switching lifters for operating the engine at idle and low loads combined with increasing the cam timing as permitted by operation on only part of the cylinders at idle. Finally, the addition of the cam phaser allows varying cam timing as desired in the intermediate load ranges where variation of the cam timing can be utilized to control emissions in a more effective manner.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A method for obtaining high performance and reduced emissions from an engine, the method comprising:

providing a high fixed intake and exhaust valve overlap selected to obtain high wide open throttle performance over the engine speed range, and reduced fuel consumption and NOx emissions through increased trapped exhaust residuals in part load operation;

equally varying the intake and exhaust valve timing to obtain superior full throttle performance over the speed range; and deactivating operation of up to half of the engine cylinders during idle and low speed/load operation to provide increased load of the operating cylinders with resulting improved fuel efficiency and lower HC emissions.

2. A method as in claim 1 including starting the engine during deactivation of up to half of the cylinders.

3. An internal combustion engine comprising in combination:

a plurality of cylinders each having intake and exhaust valves and at least one camshaft timed to operate the valves with a high performance fixed overlap;

a cam phaser for each camshaft and controlled to equally vary the intake and exhaust valve timing for superior full throttle performance over the engine speed range; and valve deactivation mechanism for up to half the cylinders and operative to deactivate the associated cylinders during idle and light load operation for increasing fuel efficiency and emission control and maintaining stable operation of the operating cylinders.

4. An engine as in claim 3 wherein the valve deactivation mechanism is operative during starting of the engine.

5. An engine as in claim 3 wherein the valves are actuated by at least one camshaft and each camshaft is controlled by a cam phaser operative to vary equally the timing of both intake and exhaust valves.

6. An engine as in claim 5 wherein a single camshaft actuates all intake and exhaust valves and the camshaft timing is controlled by a single cam phaser.

* * * * *